US006363934B2

(12) United States Patent
Metzger

(10) Patent No.: US 6,363,934 B2
(45) Date of Patent: Apr. 2, 2002

(54) RESPIRATOR FILTER PROTECTIVE COVER

(75) Inventor: Karl Metzger, Lenexa, KS (US)

(73) Assignee: Parmalee Industries, Inc., Lenexa, KS (US)

( * ) Notice: Subject to any disclaimer, the term of this patent is extended or adjusted under 35 U.S.C. 154(b) by 0 days.

(21) Appl. No.: 09/146,673

(22) Filed: Sep. 3, 1998

(51) Int. Cl.[7] ..... A62B 18/08; A62B 23/02; A62B 7/10

(52) U.S. Cl. ..... 128/206.16; 128/205.27; 128/205.29; 128/206.17; 55/DIG. 33; 55/DIG. 35

(58) Field of Search ..... 128/201.22, 201.23, 128/201.29, 202.19, 205.27, 205.28, 205.29, 205.12, 202.1, 204.17, 204.21, 204.23, 204.28, 204.27; 55/DIG. 35, DIG. 33

(56) References Cited

U.S. PATENT DOCUMENTS

| | | | | | |
|---|---|---|---|---|---|
| 1,410,928 | A | * | 3/1922 | Knoblock | 128/206.16 |
| 1,710,160 | A | * | 4/1929 | Gibbs | 128/206.17 |
| 1,821,996 | A | * | 9/1931 | Willson | 128/206.17 |
| 2,000,064 | A | * | 5/1935 | Cover | 128/206.17 |
| 2,053,896 | A | * | 9/1936 | Cover | 128/206.17 |
| 2,199,230 | A | * | 4/1940 | Schwartz | 55/DIG. 35 |
| 2,269,461 | A | * | 1/1942 | Lehmberg | 55/DIG. 35 |
| 2,744,523 | A | * | 5/1956 | Malcolm, Jr. et al. | 55/503 |
| 2,744,524 | A | * | 5/1956 | Whipple | 128/206.17 |
| 2,744,525 | A | * | 5/1956 | Whipple | 55/DIG. 35 |
| 3,307,543 | A | * | 3/1967 | Silverman | 128/206.17 |
| 3,467,965 | A | * | 9/1969 | Murphy | 2/8 |
| 3,528,415 | A | * | 9/1970 | Malmin | 128/206.17 |
| 3,712,033 | A | * | 1/1973 | Gronholz | 55/493 |
| 4,179,274 | A | * | 12/1979 | Moon | 55/524 |
| 4,197,841 | A | | 4/1980 | Brauer et al. | |
| 4,207,882 | A | * | 6/1980 | Lemere | 128/206.15 |
| 4,276,069 | A | * | 6/1981 | Miller | 55/379 |
| 4,428,907 | A | * | 1/1984 | Heijenga et al. | 422/61 |
| 4,614,186 | A | * | 9/1986 | John | 128/201.25 |
| 4,688,567 | A | * | 8/1987 | Kikuchi et al. | 128/206.15 |
| 5,022,900 | A | * | 6/1991 | Bar-Yona et al. | 55/316 |
| 5,036,844 | A | * | 8/1991 | Pouchot et al. | 128/206.17 |
| 5,086,768 | A | * | 2/1992 | Niemeyer | 128/205.24 |
| 5,222,488 | A | * | 6/1993 | Forsgren | 128/201.25 |
| 5,536,290 | A | * | 7/1996 | Stark et al. | 55/498 |
| 5,651,810 | A | * | 7/1997 | Flaherty et al. | 95/287 |
| 5,732,695 | A | * | 3/1998 | Metzger | 128/206.12 |
| 5,766,286 | A | * | 6/1998 | Flaherty et al. | 55/482 |
| 5,766,287 | A | * | 6/1998 | FLaherty et al. | 55/482 |
| 5,776,213 | A | * | 7/1998 | Flaherty et al. | 55/482 |
| 5,797,974 | A | * | 8/1998 | Flaherty et al. | 55/482 |
| 5,814,136 | A | * | 9/1998 | Wood | 96/147 |

FOREIGN PATENT DOCUMENTS

| | | |
|---|---|---|
| EP | 0 462 477 A2 | 12/1991 |

* cited by examiner

*Primary Examiner*—John G. Weiss
*Assistant Examiner*—Joseph F. Weiss
(74) *Attorney, Agent, or Firm*—Shook, Hardy & Bacon L.L.P.

(57) ABSTRACT

The present invention is a protective spark cover for covering the exterior face of a filter for use with a respirator or the like. During metal welding, smelting and cutting operations and similar activities creating sparks, splatter and the like, exposed respirator filters may be perforated and made unusable. The present invention protective spark cover provides a removable cover to protect such filter elements from welding and spark damage and other similar mechanical damage. The invention is essentially a screen cover to protect the filter element and a frame to hold the screen in place over the filter.

22 Claims, 2 Drawing Sheets

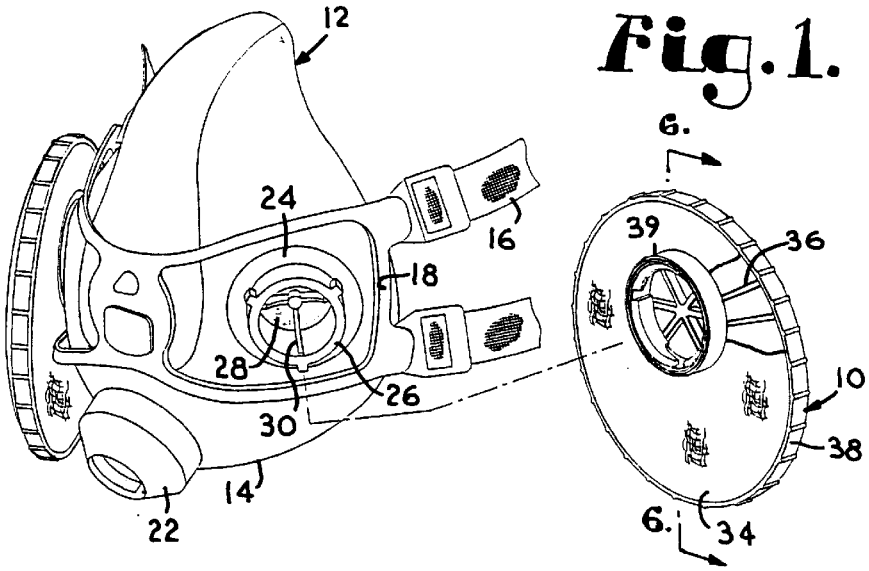
Fig. 1.
Fig. 2.
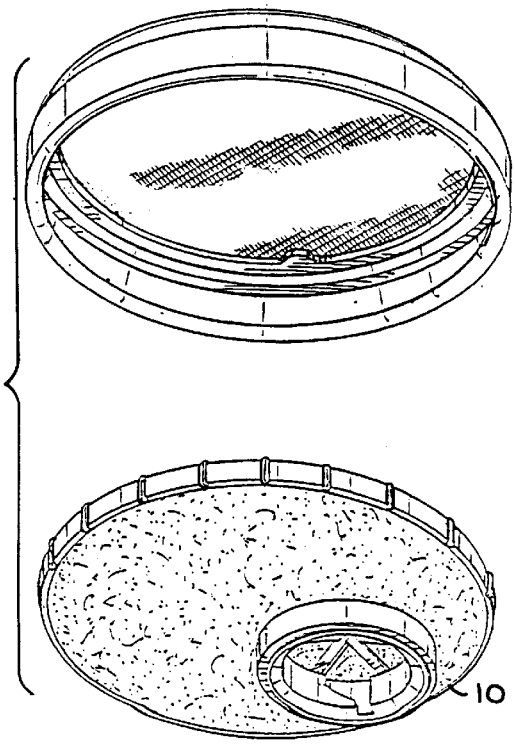
Fig. 5.
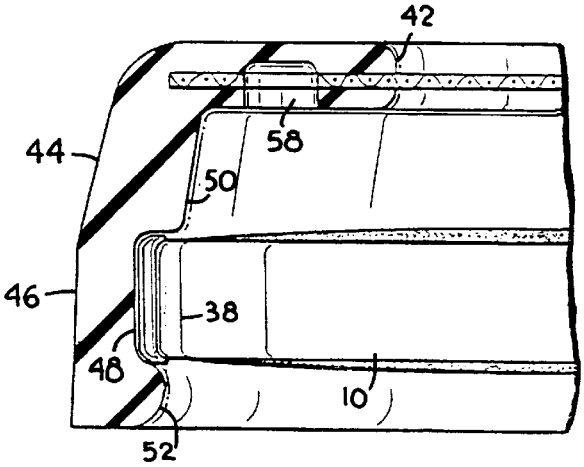

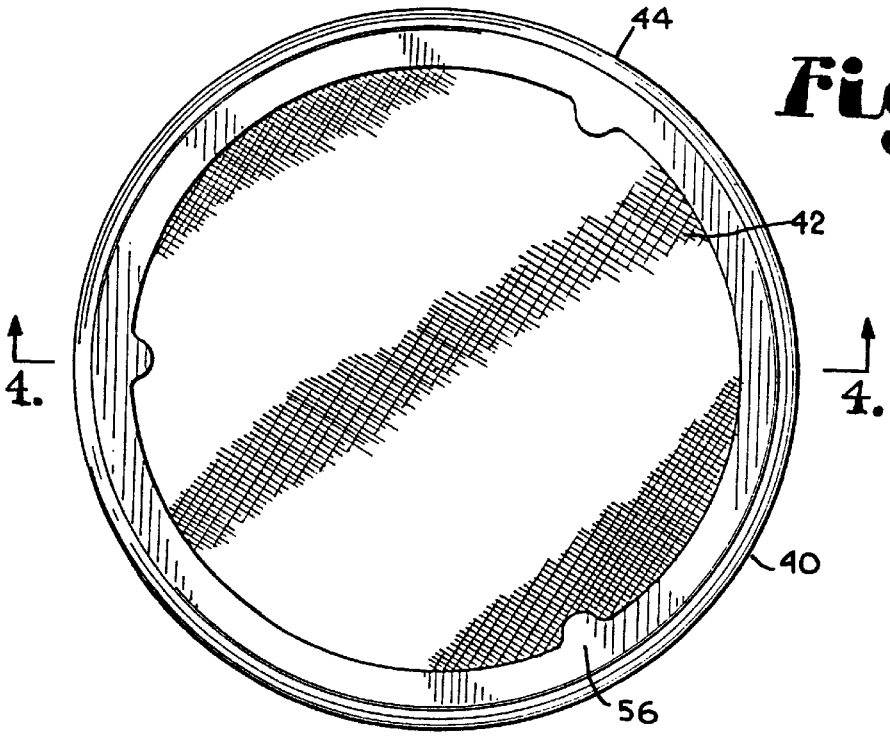
Fig.3.
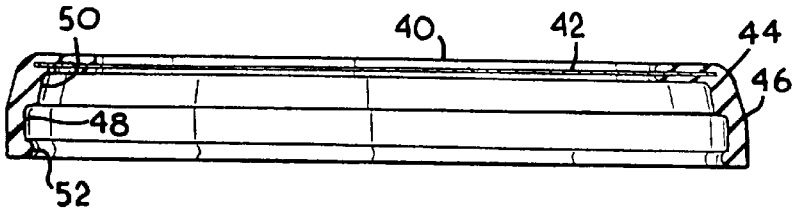
Fig.4.
Fig.6.
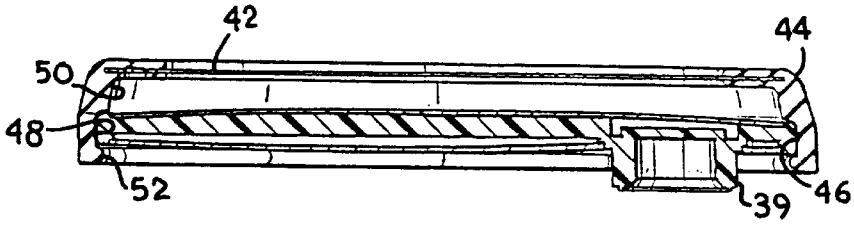
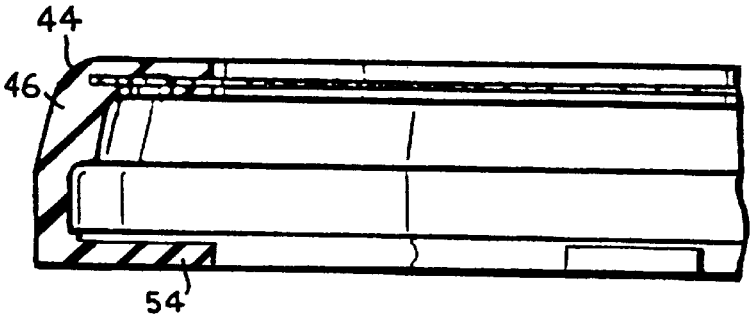
Fig.7.

RESPIRATOR FILTER PROTECTIVE COVER

BACKGROUND OF THE INVENTION

The present invention is directed to a protective spark cover for a respirator filter. More particularly, the present invention is a cover to protect respirator filters from damage due to sparks and the like such as are generated by metal working operations.

Respirators are commonly employed to filter air inhaled by a user under hazardous breathing conditions such as in environments having noxious vapors or particulates suspended in the air. Conventional respirators include a face mask which covers the nose and mouth of the user. The mask has one or more inlet valves through which air is drawn as the user inhales and an outlet valve through which air exits the mask as the user exhales. One or more filters, either integral or detachable, are connected over the inlet valve so as to form a filtered air channel between the ambient atmosphere and the interior air passages of the face mask. Thus, as air is drawn into the face mask by the user, it passes through the filter(s) thus cleansing the air and enhancing the safety of the user.

It is important that such respirators provide high efficiency both with respect to filtering out a very high percentage of unwanted constituents (rejection efficiency) as well as with respect to minimizing the pressure drop required to pull air through the respirators. Typically, the high rejection efficiency is obtained by use of multiple layers of filter fabric. In order to minimize the pressure drop required to draw air through the filters, filtration elements with large surface areas have evolved. Examples of such modern high-efficiency filtration elements are included in U.S. Pat. No. 5,732,695, issued to Metzger and U.S. Pat. No. Re. 35,062, issued to Brostrom et al., both of which are incorporated herein by reference. Further, FIG. 1 herein depicts a typical modern respirator with two filter elements. Thus, as a result of the need for efficient respirators, modern respirator filters typically present large exposed surfaces of filter material.

One hazardous breathing situation in which respirators are used is in metal working operations, such as welding, metal smelting or cutting metals, and in similar situations in which sparks, molten metal splatter and similar ignition sources (generally referred to herein as "sparks") are generated. These sparks present a problem in the use of modern respirators, in that the filter fabrics used in respirator filters typically will readily melt or char when exposed to such sparks. Thus, use of respirators around metal welding, smelting, cutting, and other activities producing sparks, can damage exposed filter elements by contact of such sparks with the filter material. Further, mechanical damage can occur from airborne chips or particles, which may cut or tear the filter material. Such damage produces voids in the filter material which results in loss of filter rejection efficiency and in filter failure. In other words, the filter integrity is compromised without the wearer knowing that the rejection efficiency is less than is expected.

Some prior art filters have included a layer of flame retardant fabric as the outer layer of filter material. However, generally such flame retardant materials can melt or char when exposed to sparks and thus do not provide effective protection from sparks. Moreover, such materials to not protect the filter from mechanical damage caused by metal chips or other particles. Therefore, there is a need to provide protection of such filter elements from damage due to flying sparks, chips and the like. Moreover, it is crucial that while providing protection for such filter elements, that the primary function of the elements, to efficiently provide filtered air to the users, not be impaired by whatever protective device is applied to the filter. Further, it is desirable for cost reasons that such a protective spark cover is removable from the filter and reusable.

SUMMARY OF THE INVENTION

It is therefore an object of this invention to provide a protective spark cover for respirator filters to prevent damage from flying sparks and the like.

It is a related object of this invention to provide a protective spark cover for respirator filters which does not impede air flow in normal use of the filter.

In one aspect, it is an object of this invention to provide a protective spark cover for respirator filters which is removable and reusable.

It is a further object of this invention to provide a filter spark cover which is durable in use and easy to maneuver on and off the filter with a minimum of handling by the user.

These and other objects of the invention are met by a respirator filter protective spark cover comprised of a protective screen effective to suppress welding sparks and the like, which screen is fitted to a flexible frame. The frame is attached to the edge of the screen and configured to conform to and grasp an edge of the filter in a removable fashion, thus holding the screen over the exposed surface of the filter. Preferably the frame holds the screen a small distance away from the surface of the filter, so as to dissipate heat from the sparks without transmitting the heat to the surface of the filter.

In one embodiment, the protective spark cover has a flexible frame, preferably a flexible plastic or rubber material, which frame fits closely to an outer rigid ring on a common type of respirator filter.

In another embodiment, the protective spark cover is provided with extended tabs or the like to grasp the soft edges of another common type of respirator filter. The present invention also encompasses a protective spark cover made integral with a respirator filter.

BRIEF DESCRIPTION OF THE DRAWINGS

FIG. 1 is a partially exploded perspective view of a respirator utilizing two filters, with one filter removed for clarity. A portion of one filter element is cut away, showing internal supports of the filter.

FIG. 2 is a exploded bottom perspective view of a filter and a protective spark cover of the present invention.

FIG. 3 is a top view of a protective spark cover.

FIG. 4 is a section view of a protective spark cover taken along section line 4—4 shown in FIG. 3.

FIG. 5 is a close up detailed partial sectional view of the edge of a protective spark cover, shown with a portion of a filter in place.

FIG. 6 is a sectional view of a protective spark cover with a filter in place.

FIG. 7 is a partial sectional view of an alternative embodiment of a protective spark cover.

DETAILED DESCRIPTION AND PREFERRED EMBODIMENTS

For general orientation FIG. 1 shows two filters 10 in conjunction with a conventional respirator 12. Conventional respirators typically include a face mask 14 which is held to a user's face by resilient straps 16 attached to mask 14. Such masks generally include an exhalation port 22 and one or more inhalation ports 24. In use the inhalation ports 24 are covered by the filter 10 and air is directed through the filters by use of a series of one-way valves 28. When the user inhales, valves 28 on the inlet ports open, allowing air to be pulled through the filter 10 into the interior of the respirator 12. Conversely, when the user exhales air is exhausted through exhalation port 22 through its associated exhalation valve (not shown). Such conventional respirators typically include one or two filters, which filters are located so as to enhance the breathing of the respirator user. The filters typically are configured as flat disk shapes held close to the mask 14 so as to minimize interference with other safety devices, such as face shields and the like (not shown). Conventional filter 10 typically includes a front filter element 32 and may include a rear filter element 34 which filter elements provide means to filter out particulate from the air. Typically such filter elements are mounted on a rigid frame 36 which frame may provide an exposed rigid outer band 38 around the periphery of the filter 10. Such filters 10 generally are removable from the face mask, although disposable respirators with non-removable filter elements are also available. FIG. 1 shows a removable filter 10 which typically would attach to the inlet port 24 of the conventional respirator using an attachment port 39.

Referring to FIGS. 2 and 3, the present invention protective spark cover 40 for attaching to and for protecting a filter 10 typically includes a screen 42 in the general shape of the filter 10 and a frame 44 attached to the edge of the screen 42 and in the general shape of the outer edge of the filter 10. FIG. 2 shows the frame forming a skirt 46 extending perpendicular to the surface of the screen 42. In a preferred embodiment, this skirt 46 flexibly fits over the edge of the filter 10, allowing the protective spark cover 40 to be removably affixed to the filter 10.

FIG. 4 shows the sectional profile of a preferred embodiment of the protective spark cover 40. FIG. 4 shows one preferred embodiment wherein the screen 42 is molded into the frame 44. As oriented in FIG. 4, the top of the protective spark cover 40 faces outwardly away from filtration device 10. Rearward of the screen, i.e., down in FIG. 4, preferably extends a skirt 46 into which skirt 46 a channel 48 is formed by a pair of ridges, a first inner ridge 50 and a second inner ridge 52. As may readily be seen in FIG. 6, the channel 48 provides a recess into which the outer band 38 of a filter 10 may fit, held in place between ridges 50 and 52. Further, inner ridge 50 holds the filter 10 a distance from screen 42.

The protective spark cover of the present invention is suitable for use with a variety of filters. The filter depicted in FIG. I has a hard formed outer band 3 8 formed around the periphery of the filter 1 0. This band 3 8 provides a means for a user to easily grasp the filter for changing filters 10 on the mask 12. The ridge 38 also provides a convenient mating surface for the present invention protective spark cover, in that, the ridges 50 and 52 of the frame 44 can readily be fit to a rigid structure such as band 38. However, filters similar to the one shown in FIG. 1 are also available which have an internal structure similar to frame 36, but do not utilize an outer band 38. Thus, one embodiment of the present invention includes an extended skirt 46 configured to grasp the relatively soft outer edge of a filter 10, without an outer band 38. One preferred way of addressing attachment to filters without an outer band is by use of extended tabs 54 as shown in FIG. 7. In this embodiment, preferably three or more tabs 54 positioned around the skirt 46 serve to grasp the edge of a filter 10. Like the protective spark cover frame 44, the skirt 46, ridges 50 and 52 and tabs 54 advantageously are flexible, so that the skirt maybe flexed onto and off of the filter 10.

Screen 42 may be constructed of generally any heat resistant materials suitable for forming a screen or open grid structure such as various kinds of metal wire, and ceramics. Precise material selection will depend on a number of factors including projected number of uses of the protective spark cover, environmental conditions anticipated, flexibility of the material involved, and durability. For example, a preferred screen is made from brass wire which provides a durable, corrosion resistant material, resistant to burn through from sparks. Similarly, aluminum, steel, bronze and copper wire mesh provide desirable screen properties. Steel wire might be suitable in applications where a limited number of uses or non-corrosive environments are anticipated. For example, if the protective spark cover is sold as part of a disposable respirator unit, steel wire or steel wire coated with a protective barrier to retard rust would be an acceptable alternative. Further, various modern ceramic substances, heat resistant fibers and the like would provide suitable screen materials in various applications.

Selection of the screen material also depends upon the grid size involved and the size of the wires making the grid. Generally stated, the openings in the screen should be sufficiently small to prevent anticipated sparks from passing the screen while maintaining a sufficiently open mesh so as to allow free passage of air through the screen to the filter element. Screen width from 10 to 100 mesh grids (10 to 100 wires per inch) generally are suitable, depending upon the wire size selected. Similarly, wire size can vary from about 0.008 to 0.020 inches. For manufacturing reasons, a standard mesh and wire size is preferred, such as 40 mesh brass with 0.010 diameter wires.

The material of frame 44 preferably is a flexible material which is easily molded such as rubber, flexible plastics and the like. A flexible thermoplastic elastomer, such as a mixture of polyester and styrene has been found to be effective. The flexibility is advantageous because it allows the respirator user to grasp the edge of the spark cover and, by flexing the frame, remove the protective spark cover 40 from the filter 10. Conversely, in applying the protective spark cover to a filter 10, the user need only push the protective spark cover 40 onto the filter 10 and the flexible nature of the skirt 46 of the spark cover frame 44 allows the ridge 52 to flex over the filter 10 and snap in place, thereby grasping the filter 10 in the channel 48 of the skirt 46. It is noted that the spark cover frame 44 could also be configured as a series of hooks, loops, or similar devices with which to attach, the spark cover 40 to the filter 10. Alternatively, a frameless spark cover may be made such as where the screen 42 is bent at its edges to form a simple skirt with which to grasp the edge of a filter 10. Moreover, the frame 44 alternatively could have threaded attachments or the like to engage similar structures found on some respirators. For example, some commercial respirators use frameless filters which are held between threaded rings (not shown). The present invention protective spark cover may advantageously include threads to mate with the threaded ring of such a frameless filter.

It is preferred in the present invention that the screen 42 is held away from the filter material a sufficient distance so that sparks contacting the screen 42 and, thereby heating the screen 42, will not project heat into the filter element 32. Advantageously then, inner ridge 50 of skit 46 is configured to provide a spacing between the filter element 32 and the screen 42. The precise spacing is not critical, but an air gap of 0.1 to 0.3 inches has been found to be effective.

In reference to FIG. 1, it is noted that the filters 10 mounted in place on a conventional respirator 12 are generally oriented to have the front element 32 of the filter 10 face away from the user. This front element 32 of the filter 10 is the portion of the filter 10 which faces towards the work and, thus, is most exposed to sparks. Therefore, in the preferred embodiment the protective spark cover 40 is configured to fit only over the front element 32 of filter 10 because the rear element 34 is less exposed to potential damage from sparks. However, it is contemplated and within the scope of the present invention for a protective spark cover to include portions of screen which extend around to the rear element 34 of the filter 10 in certain applications.

For ease of manufacture and durability of the finished protective spark cover, screen 42 is preferably molded into cover frame 44. One preferred method of molding the screen 42 into the cover frame 44 is to first precut the screen in the desired configuration, place the precut screen 42 into a molding jig and mold frame 44 onto the screen 42. FIGS. 3 and 5 show molding tabs 56 and indentations 58 typical of processes using fixtures to mold components together. Other conventional methods suitable for affixing the edge of the screen 42 to a cover frame 44 such as gluing, remelting the edge of the cover onto the screen 42, rivets, screws, and weaving portions of screen together to form a frame are also acceptable alternatives to fabrication of the present invention. It is noted that an airtight seal is not necessary between the screen 42 and the cover frame 44 nor is an airtight seal necessary for the fit between frame 44 and the filter 10. Rather, the fit between these items should be designed to generally preclude admission of sparks past the screen and onto the filter element 32 itself.

With the preferred embodiments and particular applications of this invention shown and described, it is apparent to those skilled in the art that numerous modifications and applications of this invention are possible without departing from the concepts discussed herein. For example while the filter and protective spark cover shown in the figures are generally circular or disc shaped configuration, filtration devices may be generally any shape suitable for providing a surface through which air may pass. Similarly, although the above discussion entails protection of filters for use in filtering dust, the protective spark cover is also useful to protect other types of filter media, such as exposed surfaces of chemical filters.

From the foregoing, it will be seen that this invention is well adopted to attain all of the ends and objectives set forth, along with other advantages which are obvious or are inherent to the invention.

It is contemplated by and within the scope of the claims that certain features, combinations, and sub-combinations are of utility and may be employed without reference to other features and sub-combinations.

Since many possible embodiments may be made of the invention without departing from its scope, the matters set forth in this application are to be interpreted as illustrative and not in a limiting sense. Rather the scope of the invention is set forth in the in the appended claims.

I claim:

1. A respirator worn by a user for use in welding and machining operations comprising:

a filter having a first surface directed toward the user during welding operations, a second surface opposite said first surface and a peripheral edge between said first and second surfaces;

a flexible frame having a front face and a rear face and defining an open space, said rear face configured to flexibly conform to and removably grasp said filter generally about said peripheral edge, and a screen with a grid surface and an edge, said edge fixedly attached to said front face of said frame and said grid surface extending over the open space defined by said frame, said screen having a mesh size which prevents passage of sparks through said screen and which has a mesh size which allows free passage of air, whereby air flows through said open space and into said first surface of said filter, and whereby air also flows around said frame and into at least a portion of said second surface of said filter.

2. The protective cover as claimed in claim 1, wherein said screen is a metal wire with from a 10 to a 100 mesh grid pattern.

3. The protective cover as claimed in claim 2, wherein said screen is a flexible corrosion-resistant metal.

4. The protective cover as claimed in claim 2, wherein said screen is a metal selected from the group of brass, bronze, copper, aluminum and steel.

5. The protective cover as claimed in claim 1, wherein said frame is molded into said edge of said screen.

6. The protective cover as claimed in claim 1, wherein said frame is further configured to hold said screen in a spaced relation of from 0.1 to 0.3 inches from the filter.

7. The protective cover as claimed in claim 1, wherein the frame is a molded from a flexible thermoplastic material.

8. A respirator for use in welding and machining operations, said respirator comprising:

a filter having an outer edge, an inner surface and an outer surface;

a metal screen with a surface and an outer edge, said outer edge of said screen affixed to a flexible frame, said screen having a mesh size which is effective to prevent passage of sparks and effective to allow passage of air to said outer surface of said filter for operation of the respirator, said flexible frame having a peripheral edge and a skirt extending from said peripheral edge in a direction generally perpendicular to said surface of said screen, said skirt comprising a first ridge and a second ridge, said ridges arranged so that the outer edge of said filter may be captured between said ridges, thereby removably affixing said frame and screen to said filter, wherein a portion of said inner surface of said filter is not encompassed by said ridges and is accessible to intake air for operation of the respirator.

9. The protective cover as claimed in claim 8, wherein said filter is disk-shaped and said metal screen is disk-shaped, with said outer edge being generally circular.

10. The protective cover as claimed in claim 8, wherein said screen is a metal wire with from a 10 to a 100 mesh grid pattern.

11. The protective cover as claimed in claim 9, wherein said screen is a flexible corrosion-resistant metal.

12. The protective cover as claimed in claim 9, wherein said screen is a metal selected from the group of brass, bronze, copper, aluminum and steel.

13. The protective cover as claimed in claim 8, wherein said frame is molded into said edge of said screen.

14. The protective cover as claimed in claim 9, wherein said frame is further configured to hold said screen in a spaced relation of from 0.1 to 0.3 inches from the filter.

15. The protective cover as claimed in claim 8, wherein the frame is molded from a flexible thermoplastic material.

16. A respirator for use in welding and machining operations comprising:

a means for filtering particulates, said filtering means having a first surface, a second surface and an outer periphery between said first and second surfaces;

a means for framing said filter means, said frame means having a front face and a rear face and defining an open space, said rear face configured to flexibly conform to and removably grasp said periphery of said filtering means, wherein at least a portion of said first and second surfaces are accessible to intake air during operation of the respirator, and a screen with a grid surface and an edge, said edge coupled with said front face of said frame means and said grid surface extending over the open space defined by said frame means, said screen having a mesh size which prevents passage of sparks through said screen means and which has a mesh size which allows free passage of air.

17. The protective cover as claimed in claim 16, wherein said screen is a metal wire with from a 10 to a 100 mesh grid pattern.

18. The protective cover as claimed in claim 17, wherein said screen is a flexible corrosion-resistant metal.

19. The protective cover as claimed in claim 17, wherein said screen is a metal selected from the group of brass, bronze, copper, aluminum and steel.

20. The protective cover as claimed in claim 16, wherein said frame means is molded into said edge of said screen.

21. The protective cover as claimed in claim 16, wherein said frame means is further configured to hold said screen in a spaced relation of from 0.1 to 0.3 inches from said filter means.

22. The protective cover as claimed in claim 16, wherein said frame means is molded from a flexible thermoplastic material.

* * * * *

UNITED STATES PATENT AND TRADEMARK OFFICE

CERTIFICATE OF CORRECTION

PATENT NO. : 6,363,934 B2
DATED : April 2, 2002
INVENTOR(S) : Karl Metzger

It is certified that error appears in the above-identified patent and that said Letters Patent is hereby corrected as shown below:

Title page,
Item [73], please correct the Assignee's name from "Parmalee" to -- Parmelee --.

Signed and Sealed this

Sixteenth Day of July, 2002

*Attest:*

*Attesting Officer*

JAMES E. ROGAN
*Director of the United States Patent and Trademark Office*